US010550540B2

(12) United States Patent
De Siena

(10) Patent No.: US 10,550,540 B2
(45) Date of Patent: Feb. 4, 2020

(54) MANHOLE COMPRISING A DEVICE FOR SAFETY CLOSING AND LOCKING THE MANHOLE

(71) Applicant: DSG S.r.l., Milan (IT)

(72) Inventor: Davide De Siena, Marina di Strongoli (IT)

( * ) Notice: Subject to any disclaimer, the term of this patent is extended or adjusted under 35 U.S.C. 154(b) by 0 days.

(21) Appl. No.: 15/759,520

(22) PCT Filed: Sep. 13, 2016

(86) PCT No.: PCT/IB2016/055440

§ 371 (c)(1),
(2) Date: Mar. 13, 2018

(87) PCT Pub. No.: WO2017/046696

PCT Pub. Date: Mar. 23, 2017

(65) Prior Publication Data

US 2019/0145079 A1 May 16, 2019

(30) Foreign Application Priority Data

Sep. 14, 2015 (IT) ..... 102015000051147

(51) Int. Cl.
*E02D 29/14* (2006.01)
*E05B 65/00* (2006.01)
(Continued)

(52) U.S. Cl.
CPC ..... *E02D 29/1427* (2013.01); *E02D 29/14* (2013.01); *E02D 29/149* (2013.01);
(Continued)

(58) Field of Classification Search
CPC ..... E02D 29/1427; E02D 29/1454; E02D 29/149; E02D 29/12; E02D 29/14;
(Continued)

(56) References Cited

U.S. PATENT DOCUMENTS 845,182 A * 2/1907 Letts ..... E05B 65/006 70/168
2,057,866 A 10/1936 Weber
(Continued)

FOREIGN PATENT DOCUMENTS

| | | |
|---|---|---|
| EP | 2186946 | 5/2010 |
| FR | 2892752 | 5/2007 |

*Primary Examiner* — Abigail A Risic
(74) *Attorney, Agent, or Firm* — Themis Law

(57) ABSTRACT

A manhole includes a device for safely closing and locking the manhole, which has a cylinder with centering pins that is attached to a slab and is rotatable with an operating key acting on the pins, and further includes an anti-burglary block, which in locked position is positioned inside the cylinder and hides and protects an anti-theft bolt positioned inside a hole, which crosses the entire anti-burglary block and has a larger diameter at the front and the same diameter as the anti-theft bolt in the back, so as to receive the anti-theft bolt in a threaded spot in the inner wall of the cylinder and enable placement of the anti-theft bolt in the body of the anti-burglary block when totally tightened into the threaded spot, wherein the end of the anti-theft bolt, in closed position, is housed in a locking hole on a circular support of the cover.

10 Claims, 11 Drawing Sheets

(51) Int. Cl.

| | |
|---|---|
| ***E05B 13/00*** | (2006.01) |
| ***E05C 9/10*** | (2006.01) |
| ***E05B 17/18*** | (2006.01) |
| ***E05B 35/00*** | (2006.01) |
| ***E05C 9/00*** | (2006.01) |
| ***E05B 17/00*** | (2006.01) |

(52) U.S. Cl.
CPC ..... *E02D 29/1454* (2013.01); *E05C 9/10* (2013.01); *E02D 2200/1628* (2013.01); *E02D 2450/00* (2013.01); *E05Y 2900/612* (2013.01)

(58) Field of Classification Search
CPC ..... E02D 2450/00; E02D 2200/1628; E05B 13/004; E05B 65/006; E05B 17/002; E05B 17/18; E05B 17/2023; E05B 35/008; E05C 9/10; E05C 9/00; E05Y 2900/612
See application file for complete search history.

(56) References Cited

U.S. PATENT DOCUMENTS

| | | | | |
|---|---|---|---|---|
| 2,363,567 | A | 11/1944 | Blakeman | |
| 5,033,696 | A * | 7/1991 | Horstman | E05B 17/18 244/129.4 |
| 6,739,796 | B1 * | 5/2004 | Del Nero | E02D 29/1427 404/25 |
| 2008/0256997 | A1 * | 10/2008 | Nolle | E02D 29/14 70/167 |
| 2016/0053458 | A1 * | 2/2016 | Stadler | E02D 29/1418 404/25 |
| 2017/0081821 | A1 * | 3/2017 | Shokouhi | E02D 29/1427 |
| 2017/0081822 | A1 * | 3/2017 | Burr | E02D 29/1427 |
| 2018/0223498 | A1 * | 8/2018 | Bechler | E02D 29/1427 |
| 2018/0274198 | A1 * | 9/2018 | Finn | E02D 29/1427 |

* cited by examiner

MANHOLE COMPRISING A DEVICE FOR SAFETY CLOSING AND LOCKING THE MANHOLE

The present invention refers to a manhole comprising a device for safety closing and locking the manhole.

In particular, the present invention refers to a manhole comprising a device for safety closing and locking the manhole, of the type having its own supporting frame. The device can be applied in particular, but not in a restrictive manner, in manhole covers for manholes and culverts which are subject to vandalism or theft.

A problem of the prior art is represented by theft of copper cables, fiber optic cables and the like, often causing serious inconvenience to the services and problems of order and public security. Moreover, the manholes or wells of the prior art can be easily used as possible locations of explosive devices, for terrorist or criminal attacks. In fact, some known manhole covers do not present safety lock systems. Some others are equipped with various types of safety closure devices if they are dedicated to the safeguard of wells or manholes located in areas particularly at risk for the public safety, such as roads, railway, docks, ports, squares or generally places frequented by the public, or containing value materials, such as copper wires or optical fibers, or, in general, in the case of wells or manholes of a certain strategic importance.

These known safety closure devices normally employed in the manhole covers of common applications do not provide adequate security and, moreover, are high cost.

Many other existing manhole covers comprises very sophisticated safety closure devices, but they are not very reliable and robust. In addition they require excessive maintenance and, at the same time, do not offer adequate security because they can be easily tampered with easy utensils and tools.

As an example of prior art solutions, the patent FR2892752 describes a device having a lock insert carrier removably fixed in a housing of a cylindrical part integrated to a cover for preventing access to a head of a cylindrical operating axle. Bolt forming stems are slidingly mounted in respective strikers of a support frame between engaging and disengaging positions, where the cover is fixed to the frame by fixation screws. An operating key is introduced in the housing for cooperating with the head so as to rotatively drive the axle and displace the stems to the disengaging position for unlocking the stems from the strikers.

A second solution of the paten EP2186946 describes a safety arrangement having a locking device with an actuating element. A rotation of the locking device is moved between the locking position and releasing position in back and forth manner. A removable lock and an access authorization monitoring device are fitted to block closing position of the lock.

Nevertheless, the prior art solutions don't describe a device comprising an anti-burglary block providing at the same time a first function for blocking the device and a second function which prevents the use of a specific key.

Scope of the present invention is to provide a manhole comprising a device for safety closing and locking the manhole which ensures high safety in closing and locking the manhole covers to which is applied, preventing the opening to unauthorized personnel not in possession of specific instruction and special instruments, robust and reliable, thus having characteristics such as to overcome the limits which still affect the cover comprising a device for safety closing and locking the cover with reference to the known art.

According to the present invention, a manhole comprising a device for safety closing and locking the manhole is provided, as defined in claim 1.

For a better understanding of the present invention it is now described a preferred embodiment, purely by way of non-limiting example, with reference to the accompanying drawings, in which.

Figure 5:
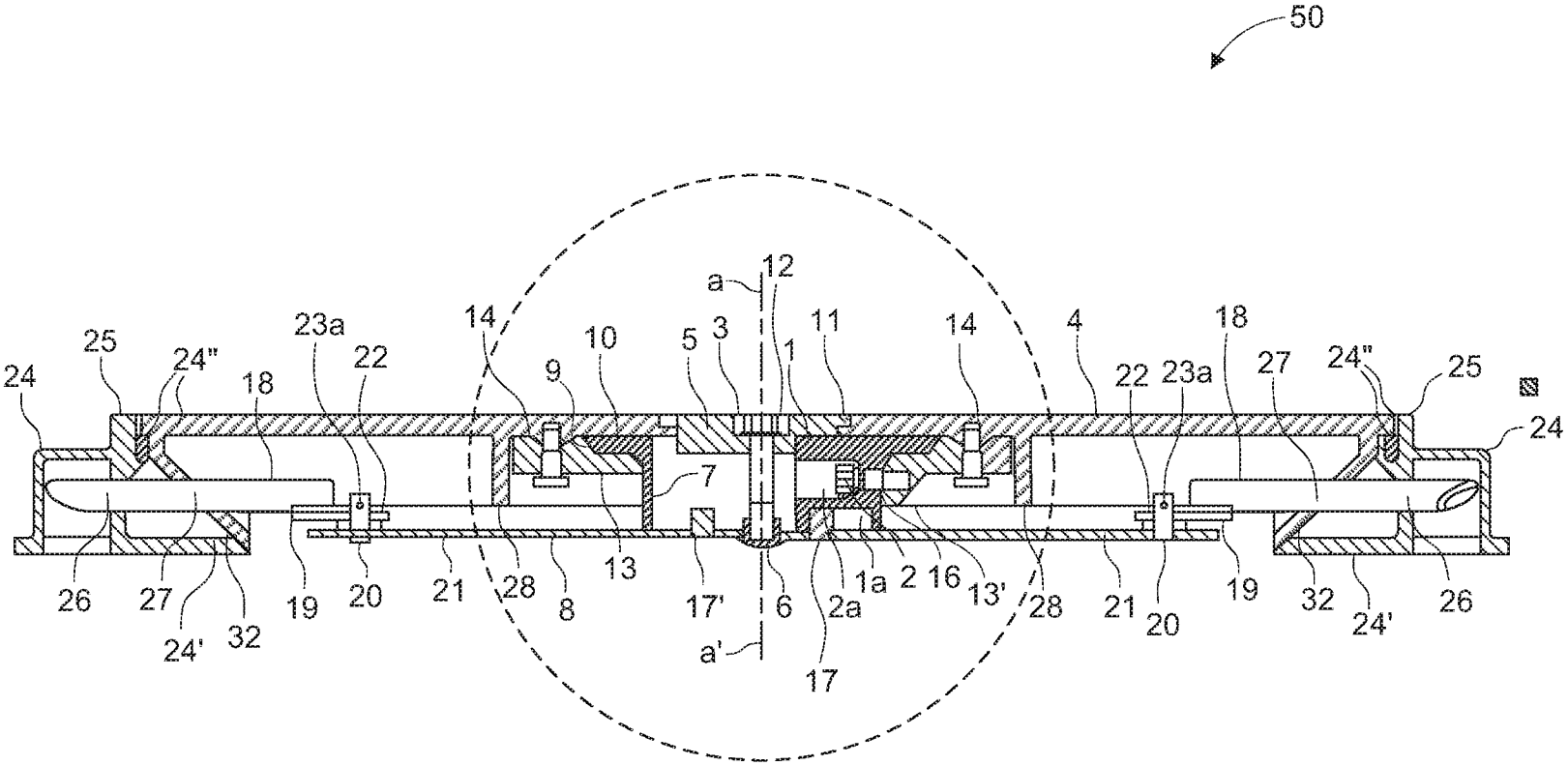
FIG. 5 shows the main section of the assembly manhole-frame comprising the device for safety closing and locking the manhole, according to the invention.
Figure 6:
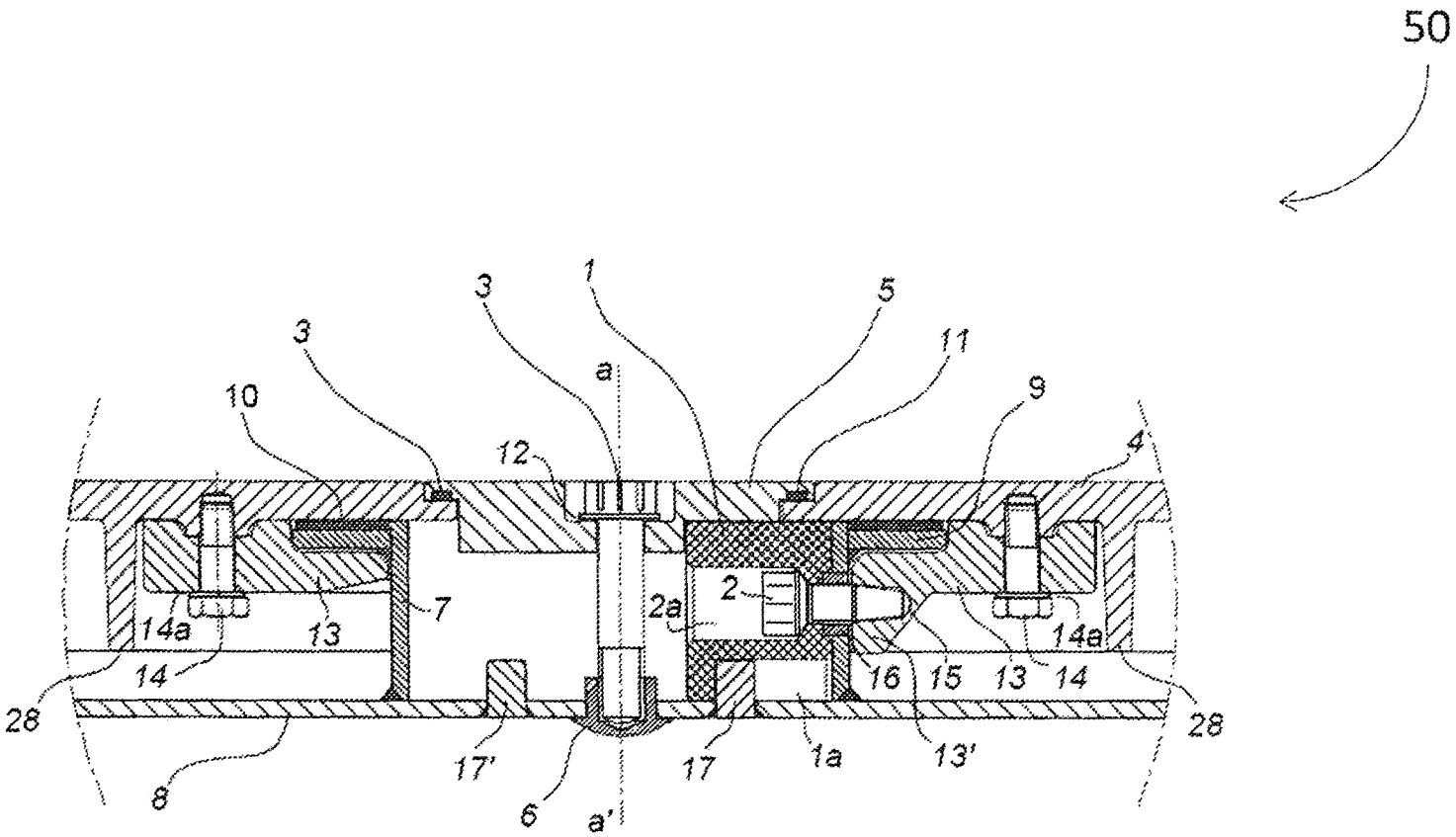
FIG. 6 shows a detailed view of the device for safety closing and locking the manhole and of the coupled anti-theft bolt, according to the invention.
Figure 10:
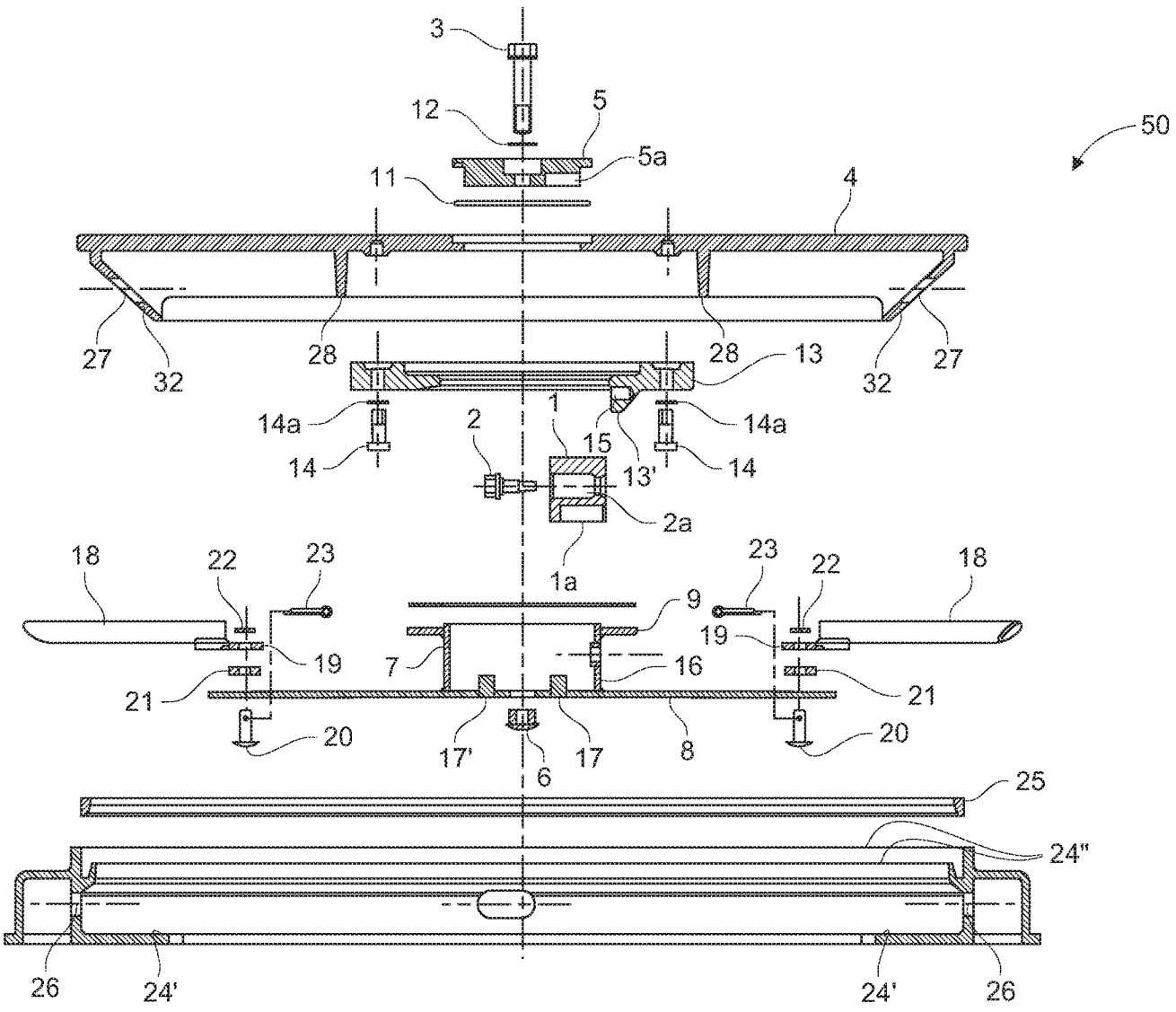
FIG. 10 shows an exploded view of the manhole comprising a device for safety closing and locking the manhole, according to the invention.
Figure 11:
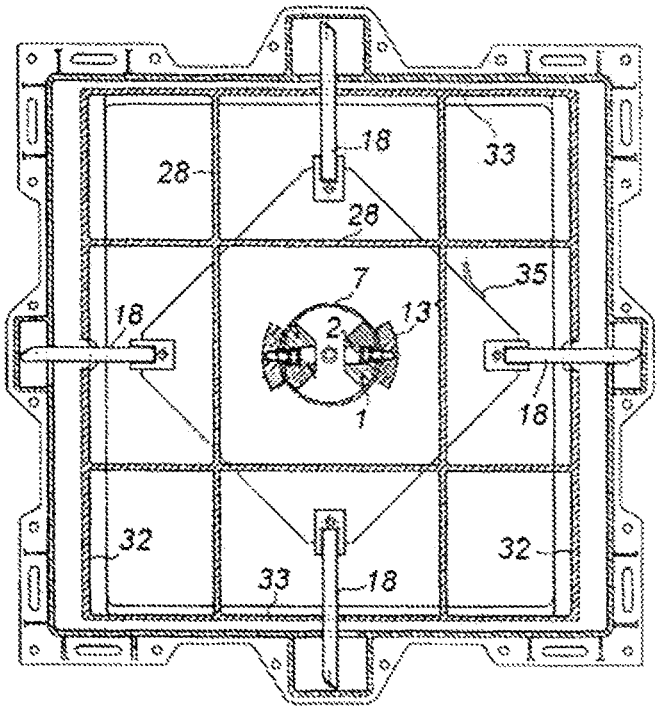
FIG. 11 shows a manhole having a plurality of anti-burglary blocks.

With reference to those figures and, in particular, to the FIGS. 5, 6 and 10, a manhole 50 comprising a device for safety closing and locking the manhole is shown, according to the invention. In particular, the manhole 50 comprising a device for safety closing and locking the manhole comprises a cover 4, for example made of cast iron, provided, in the lower portion, with threaded holes, in variable number depending on the size of the manhole 50.

The cover 4 comprise a central hole closed by a lid 5, for example made of cast iron, whose closing edge is provided with a groove as a seat of a synthetic material gasket 11 acting as hermetic and waterproof closure to avoid infiltration of external liquids.

The lid 5 is locked by means of an antitheft bolt 3 tightened into the threaded seat of a dice 6 having a round head, welded to a lower slab 8, mating with an anti-burglary block 1 by means of a location groove 5*a*, realized on the lower base of the lid 5, which defines the centering and blocks the rotation.

Advantageously according to the invention, the bolt 3 constitutes a first security element of the closure device, being of a burglar type, difficult to be unscrewed without using an authorized key. This bolt 3 can be of appropriate design, size and with the strength of materials classes, treatments and surface coatings according to application needs. In this case, anti-theft bolts are encoded and only be loosened with the encoded and personalized key, available in exclusive form to the purchaser or to the person responsible for the closure device, ensuring maximum privacy and secrecy of the code.

Other bolts 14 can be inserted in the threaded holes of the cover 4 to mount a circular cast iron support 13, shaped to allow the coupling and maneuvering of a device for safety closing the manhole 50.

According to an aspect of the invention, the device for safety closing the manhole 50 is made of stainless steel.

According to another aspect of the invention, the safety closure device comprises a stainless steel cylinder 7 closed on the lower base and surmounted by a circular crown 9, also made of stainless steel, welded near the upper end of the cylinder along a peripheral edge of the crown 9. The lower base of the cylinder 7 is closed, by means of welding, by the stainless steel slab 8 having a square shape having vertices provided with holes housing supporting pins 20 configured to support locking rods 18.

According to an aspect of the invention, the locking rods 18 are made of stainless steel smooth rods having a diameter optimized to allow adequate resistance to the stresses caused by improper forcing attempts.

The locking rods 18 are welded to plates 19 configured to connect the locking rods 18 to the slab 8 by means of the pins 20, having a circular head.

According to another aspect of the invention, the locking rods 18 are well connected to the slab 8 by means of a bronze washer 21 to ensure the perfect height alignment of the locking rods 18 with the axes of holes 26 and 27, a washer 22 and a cotter pin 23. Each locking rod 18 can then rotate around the axes of the pins 20. Thus, a rotation of the slab 8 around a main axis of rotation "a-a" of the manhole 50 imparts a roto-translational movement to each locking rod 18, allowing to advance toward or to retreat from slotted guide holes 27 provided in the edges 32 and 33 of the manhole, and to insert into holes 26 provided in the supporting frame, allowing the closing or opening of the manhole 50.

The volume delimited by the walls of the cylinder 7 constitutes the housing of the main element of the closure device, constituted by the anti-burglary block 1, which represents the heart of the whole system and the fundamental part of the invention.

Unscrewing the safety bolt 3 and extracting the lid 5, it's possible to access to the anti-burglary block 1, for example made of stainless steel or other metal alloys with high mechanical characteristics.

According to an aspect of the invention, the anti-burglary block 1 has a thickness equal to the height of the cylindrical housing, a curve lateral surface having curvature radius perfectly adaptable to the internal lateral surface of the cylinder, shape and contour devoid of corners and grooves which could offer the possibilities of using levers or burglary tools. In the working position inside the cylindrical volume, the anti-burglary block 1 has the front side facing the center of the cylinder and it is provided with a hole 2*a* to house a second anti-theft bolt 2 realized ad hoc and robust to tentative burglary. The hole 2*a* passes through the entire anti-burglary block 1 and has a greater diameter on the front side, in order to allow the insertion of the anti-theft bolt 2 and of a specific key. Instead, on the surface in contact with the cylindrical wall, the hole dimensions are equal to the nominal diameter of the anti-theft bolt plus or minus the tolerance values. The dimensions and the depth of the seat of the antitheft bolt 2*a* are designed to guarantee the mechanical resistance and, at the same time, to place the head of the anti-theft bolt more inside the anti-burglary block to make it not visible and not accessible without the specific codified key.

The bolts 2 and 3 are anti-burglary but they have a different code. In particular, according to an aspect of the invention, the bolt 2 is provided with a cylindrical hollow head in order to allow a smaller occupancy of the anti-theft key, further increasing the safety of the device. Thus, it's important to increase the depth of the housing of the bolt 2 in the hole 2*a*, by reducing as much as possible the diameter of said hole 2*a*. In this way, the anti-theft bolt 2 is inaccessible and cannot be disassembled without the proper codified key.

The anti-theft bolt 2 is screwed into a threaded spot 16 formed in the wall of the cylinder 7 and, to complete clamping, thanks to the end shape of the stem, smooth and tapered, it is housed in a locking hole 15 realized in a protrusion 13' of the circular cast iron support 13, the latter integral to the manhole 50 by means of its bolt junction. Therefore, the main anti-theft bolt 2, completely screwed into its seat, achieves the locking of the device in the closed position, in the maximum extension of the locking rods 18 in their correspondent housings 26.

Therefore, the opening of the manhole 50 necessarily requires the removal of the anti-burglary block 1 unscrewing the anti-theft bolt 2 by means of the special codified key.

Figure 7B:
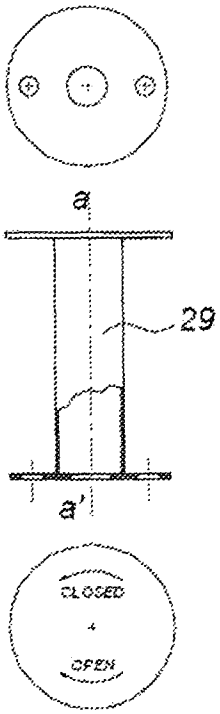
FIGS. 7A-7B show a schematic section view of the work-key for closing in work position of the device for safety closing and locking the manhole and the main section views of the work-key, according to the invention.
Figure 7A:
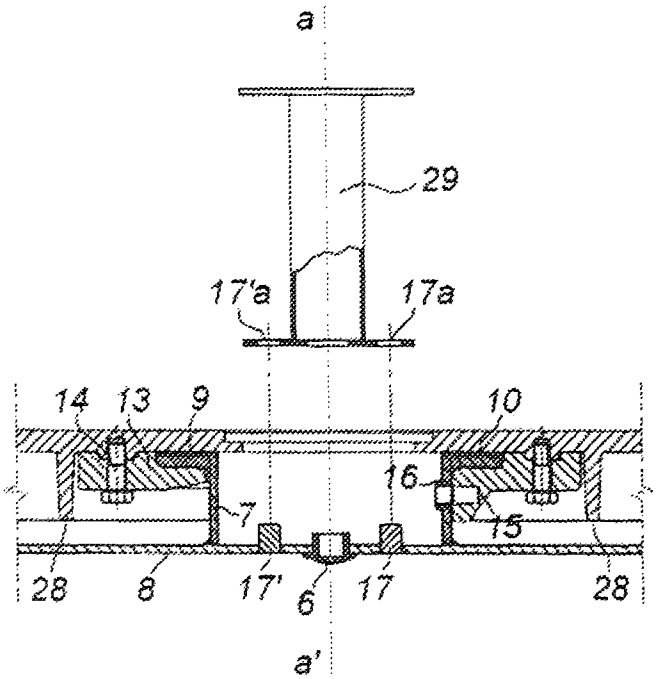
Figure 8B:
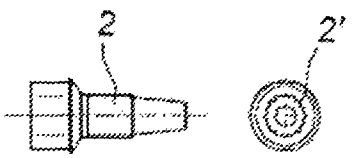
FIGS. 8A-8B show the anti-theft bolts used respectively for blocking the manhole to a cylinder comprised in the manhole and for the coupling to the block burglary, according to the invention.
Figure 8A:
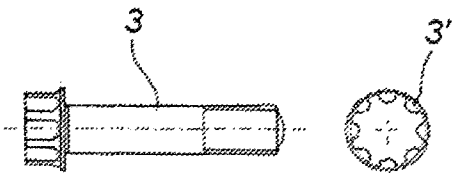
Figure 9B:
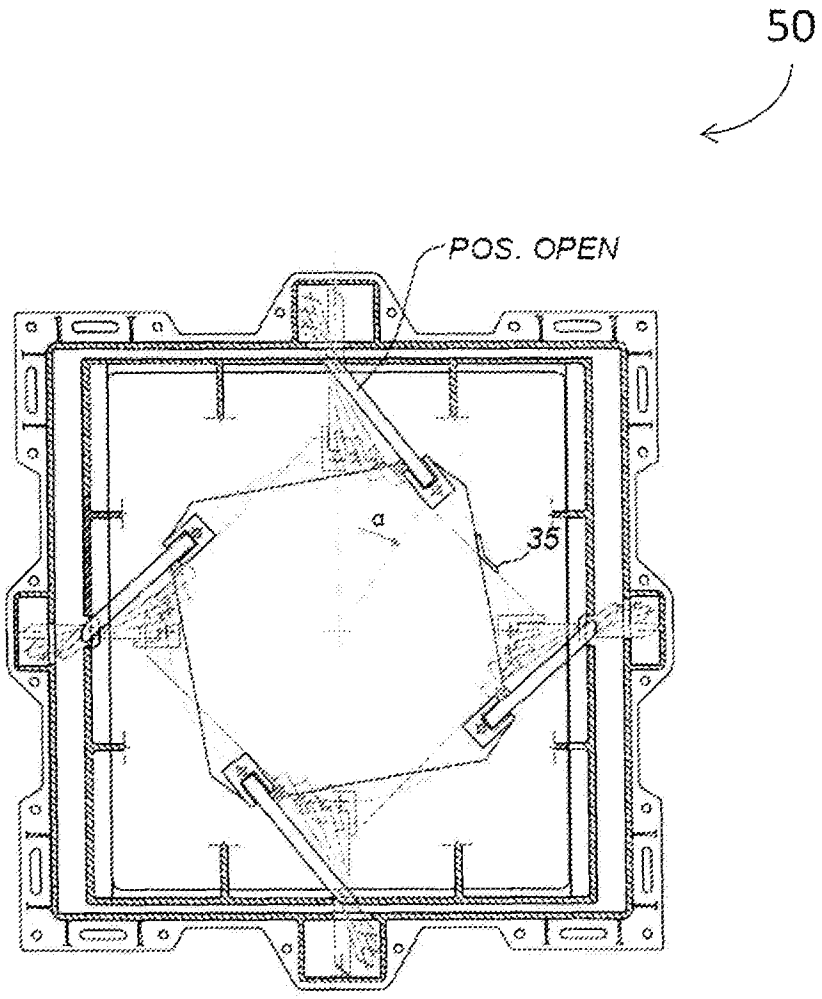
FIGS. 9A-9B show the cover comprising a device for safety closing and locking the manhole respectively in a closing position and in an opening position, according to the invention.
Figure 9A:
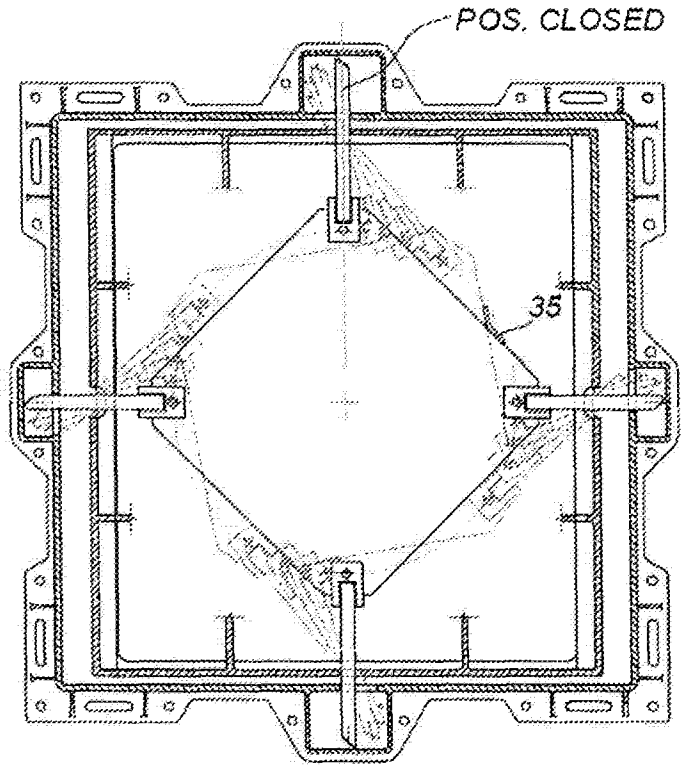

The manhole 50 comprises centering pins 17 and 17'. Removing the anti-burglary block 1 makes the pin 17 removable, which is predisposed for the application of an operating key 29 of the closure device, as shown in FIGS. 7*a*-7*b*, by means of which it is possible to impart a rotation to the device by leveraging on the centering pins 17 and 17'. In fact, imparting a rotation in a clockwise direction to the key 29 generates a couple of forces whose resultant act on the pins 17 and 17', producing the rotation of the assembly cylinder-lower sheet. Therefore, the roto-translatory movement of the locking rods 18 which, at that stage, withdraw from their seats allowing the opening of the manhole. The FIGS. 9*a*-9*b* shows the closure device respectively in the closed position (FIG. 9*a*) and in the open position (FIG. 9*b*).

The phase of closing and locking the manhole 50 involves the counterclockwise rotation of the closing device by means of the same key 29 and, subsequently, the insertion of the anti-burglary block 1, whose correct position is determined by the presence of the pin 17 acting as centering element.

On the lower base of the anti-burglary block 1 there is a slot 1*a* within which the centering pin is inserted. When the anti-burglary block fits with its seat, the anti-theft bolt 2 is inserted and screwed till to the end of run within the locking hole 15 tightening it by means of the appropriate codified key. The keys necessary to unscrew the antitheft bolts 2 and 3 are encoded and delivered in one copy to the owner or operator of the manhole.

The angle of opening and of closure of the device is calculated in an exact manner as a function of the size and geometry of the manhole to which it is applied. For this purpose, an opening and closing lock 35, shown in FIGS. 1 and 9, requires the maximum turning angle calculated at the design stage.

The manhole 50 comprises reinforcement ribs 28 to make the manhole 50 more robust, as illustrated in FIG. 5.

The closing device is designed to facilitate the movement and removal of the manhole from the support frame. For this reason, the metal slab 8 of the closure device does not project beyond the maximum height of the ribs 28 and of the cast iron edges of the manhole 50 to allow the removal of the manhole 50 from the seat of the frame. In particular, during removal, the manhole 50 can be dragged allowing it slides on the edge 24", shown in FIGS. 5 and 10, of the frame without obstacles. For this reason, both a threaded bolt 6 and pins 20 are provided with a round head, to create as little friction as possible and do not constitute barriers to the slippage of the manhole 50 on the edge of the frame. Alternatively, both the pins 20 and the threaded bolt 6 can be chosen with a countersunk head or directly welded to the lower surface of the slab 8, so as do not produce protrusions.

Figure 1:
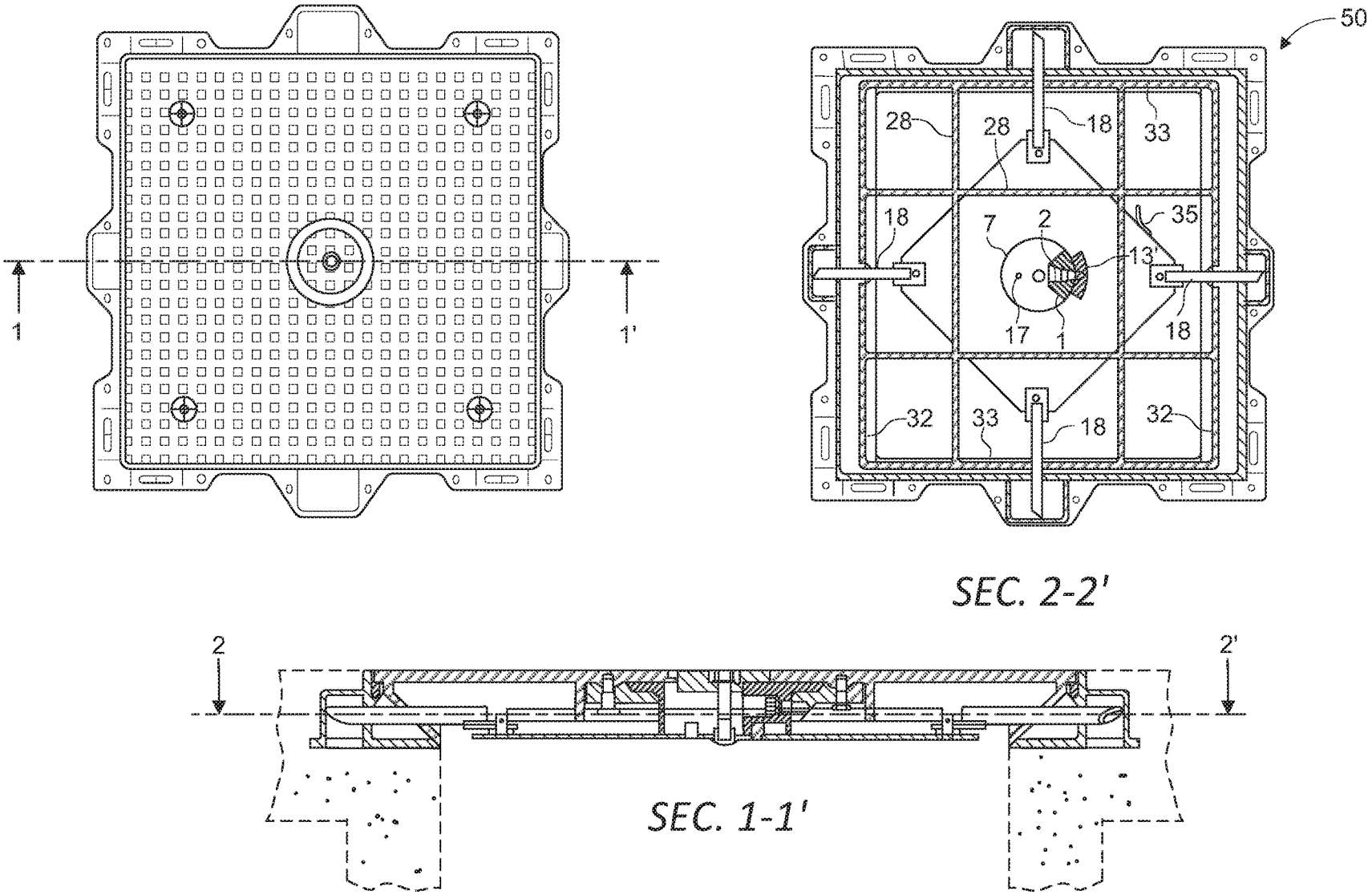
FIGS. 1A-1C show respectively a schematic top view, a section view along section 2-2' and a section view along section 1-1' of a manhole comprising a device for safety closing and locking the manhole, according to the invention.
Figure 2:
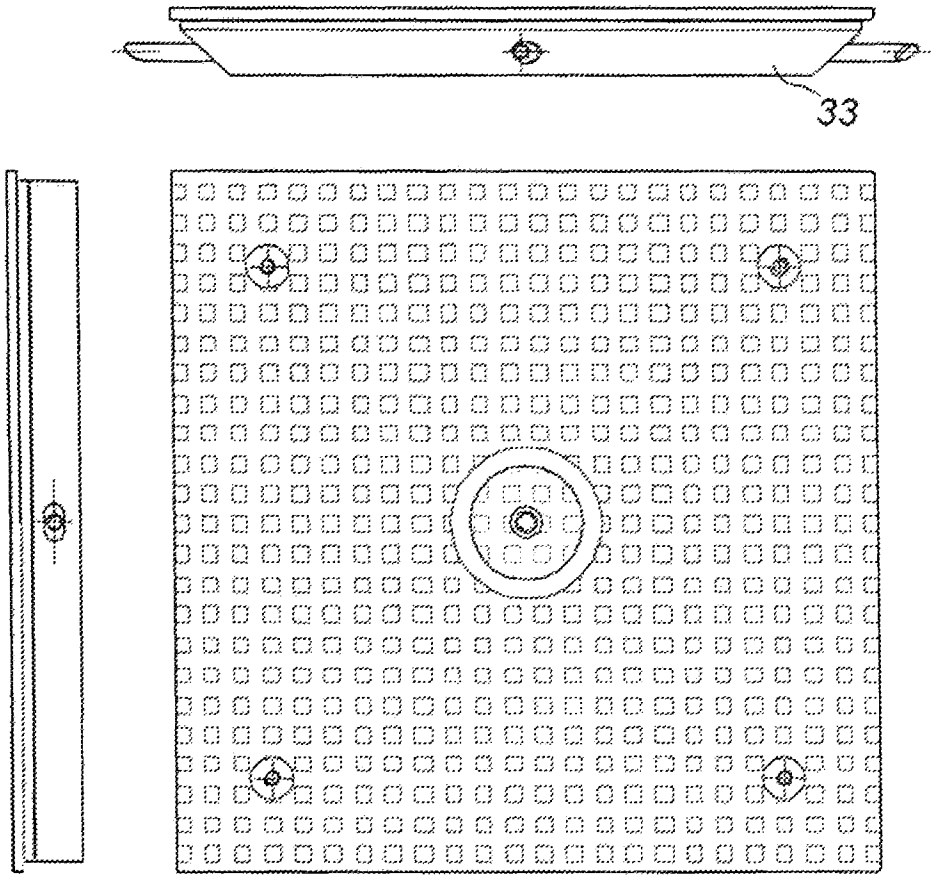
FIG. 2 shows a top view and two side views of the manhole comprising a device for safety closing and locking the manhole, according to the invention.
Figure 3:
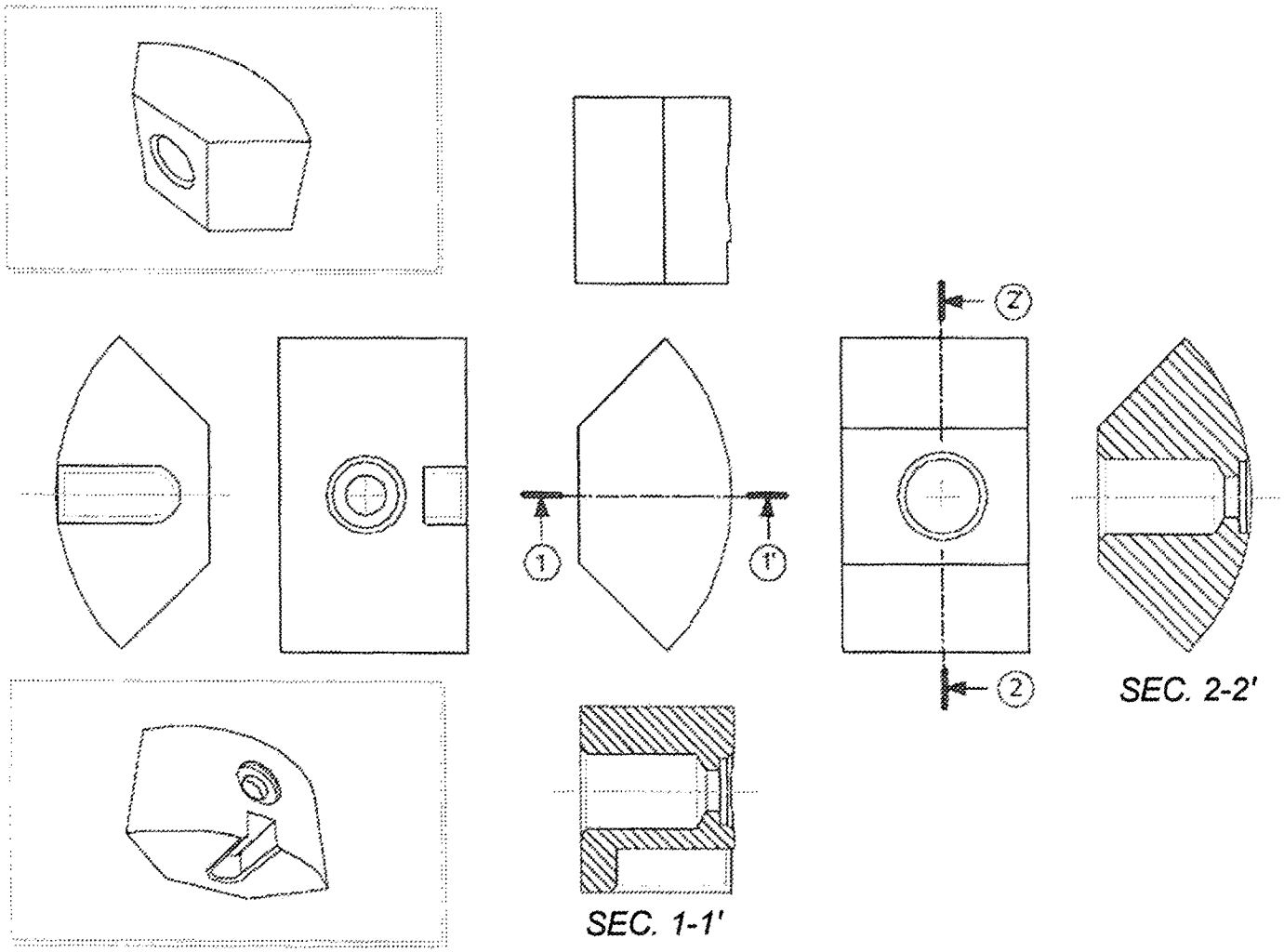
FIG. 3 shows schematic section views and perspective views of the device for safety closing and locking the manhole, according to the invention.

According to an aspect of the invention, the peripheral edges of the manhole 50, as shown in FIGS. 1, 32 and 33, that can be made in a single block of iron casting together with the upper cover 4 and the ribs 28, are designed not only to for giving structural robustness but also to provide greater ease of removal of the manhole from the seat of the frame. The vertical peripheral edges 33 in addition to having a structural function have also the function of allowing the slippage of the manhole on the frame edge 24" shown in FIGS. 5 and 10: the manhole can be opportunely relieved from the seat only on one side of a minimum amount equal to the thickness of the cover 4, and dragged by sliding on the edge of the frame. The two edges 32, orthogonal to the preceding, are inclined by an angle such as to allow both the support on the frame and both for facilitate the removal of the manhole from the seat of the frame. Consequently, the vertical edges 33 are chamfered at the ends by an angle equal to the inclination of the inclined edges 32.

Figure 4:
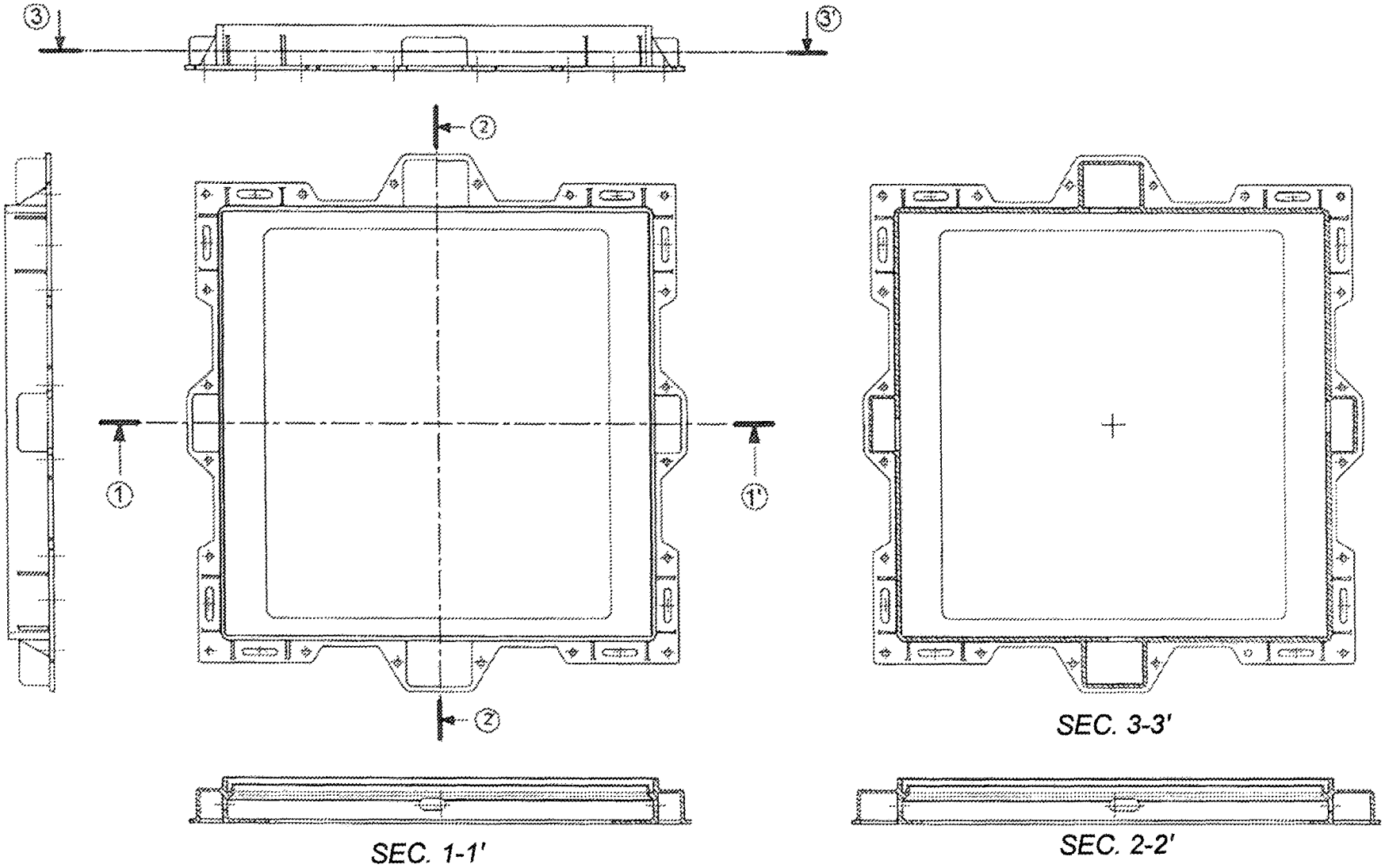
FIG. 4 shows schematic views and section views of the frame of the manhole comprising a device for safety closing and locking the manhole, according to the invention.

The manhole described is realized in a way do not allow infiltration of liquids from the outside, safeguarding, in particular, the volume inside the cylinder 7 of the safety closure device, protecting the anti-burglary block and the anti-theft bolt from corrosion or fouling caused by possible infiltrations. For this purpose, the manhole 50 comprises a gasket 11 shown in FIG. 6 on the closing edge of the upper lid 5 made of cast iron, a washer 12 shown in FIG. 6 made of synthetic material under the head of the anti-theft bolt 3 of the lid 5 and a gasket made of synthetic material applied over a gasket having a circular support crown 10 shown in FIG. 6 in contact with the lower surface of the cover 4. The latter gasket 10 is connected with tolerance to the lower plane of the cover 4 when the safety bolt 3 of the lid 5 is loosened, allowing the cylinder 7 rotates during opening and closing operations of the manhole, while it is tightly in contact with the lower plane of the cover 4 following the tightening of the safety bolt 3 of the lid 5; at the same time, also the seal of the lid 5 ensures the hermetic closure between its contact surfaces. Finally, also the supporting frame of the manhole, shown in FIG. 4, made in cast iron or other metal alloys, presents a peripheral housing for the gasket 25, shown in FIGS. 5 and 10, thus preventing seepage of liquids from the outside towards the inside of the enclosed generic compartment or leaking of any unpleasant odors into the outside environment. The gasket of the frame 25 is also anti-noisy for the passage of vehicles preventing collisions between metal parts. The gasket 10, 11, the washer 12 and 25 are all made of fireproof material in order to avoid damage by means of combustion fuels.

The manhole here described can be applied to safety close wells, aqueducts, sewers, wells service of electrical and telephone lines, and hatches in general.

According to the invention, the manhole can be spheroidal or laminated or of square shape.

Furthermore, according to an aspect of the invention, the manhole can be made of steel, or of carbon or of stainless steel, or of cast iron or different types of metallic alloys.

All the components of the invention are realizable or by the melting process or by machining and assembly in the factory and, in general, with the methods and equipment usually employed in the common construction practice.

Advantageously according to the invention, it's not necessary a particular maintenance for the manhole 50.

Advantageously according to the invention, the manhole 50 is easily realized and used.

Advantageously according to the invention, the manhole is low cost.

Finally it is clear that the manhole comprising a device for safety closing and locking the manhole described and illustrated here can be modified and varied without departing from the protective scope of the present invention, as defined in the appended claims.

The invention claimed is:

1. A manhole (50) comprising a device for safety closing and locking the manhole (50), the device comprising:

a cylinder (7), attached to a slab (8) which comprises centering pins (17, 17'), the cylinder (7) being rotatable around an axis a-a' by action of an operating key (29) acting on the centering pins (17, 17'); and at least one anti-burglary block (1), which in locked position is positioned inside the cylinder (7) with one of the centering pins (17, 17'), said block (1) having a thickness equal to a height of the cylinder (7) and a curved surface matching an inner wall of the cylinder (7), wherein said block hides and protects an anti-theft bolt (2) inside a hole (2*a*), which crosses the entire anti-burglary block (1), said hole (2*a*) having a diameter, in a front portion, larger than a diameter of the anti-theft bolt (2) and said hole further having a diameter, in a back portion, equal to the diameter of the anti-theft bolt (2), an inner wall of the cylinder (7) having a threaded spot (16) configured to receive the anti-theft bolt (2), the anti-theft bolt (2) engaging within a body of the anti-burglary block (1) when tightened into the threaded spot (16), and wherein an end of the anti-theft bolt (2), in a closed position of the manhole, is housed in a locking hole (15) on a circular support (13) of a cover (4) of the manhole.

2. The manhole (50) according to claim 1, wherein there is a plurality of anti-burglary blocks (1), contained within the cylinder (7).

3. The manhole (50) according to claim 1, wherein the anti-theft bolt (2) is provided with a hollow cylindrical encoded head.

4. The manhole (50) according to claim 1, further comprising a second anti-theft bolt (3) tightened into a threaded seat of a dice (6) having a round head, the dice being welded to the slab (8), and mating with the anti-burglary block (1) by way of a location groove (5*a*) defined on a lower base of a lid (5), which engages and blocks rotation of the second anti-theft bolt.

5. The manhole (50) according to claim 4, wherein the cylinder (7) is surmounted by a circular crown (9) and is closed on its base, by welding, by the slab (8).

6. The manhole (50) according to claim 1, wherein the slab (8) is squared shaped and has vertices provided with holes housing supporting pins (20) configured to support locking rods (18), and wherein the slab (8) is rotatable around the axis a-a' by a maximum maneuver angle delimited by a lock (35), by action of the operating key (29), which acts on the pins (17, 17'), thereby allowing a roto-translatory movement of the locking rods (18) in positions of opening and closing in seats (26) of a frame of the cover.

7. The manhole (50) according to claim 5, further comprising:

a first gasket (10) applied over the circular crown (9) and in connection with a lower plane of the cover (4) comprising a central hole closed by the lid (5) when the second anti-theft bolt (3) is loosened;

a second gasket (11) of the lid (5); and a washer (12) of the bolt (3).

8. The manhole (50) according to claim 7, further comprising a circular support (13) connected to the cover (4), the circular support being provided with a protrusion (13') comprising the locking hole (15).

9. The manhole (50) according to claim 6, wherein the locking rods (18) are connected to the slab (8) with at least one washer (22), at least one alignment washer (21) and at least one cotter pin (23), adapted to roto-translate in guide holes (27) defined in the cover.

10. The manhole (50) according to claim 1, wherein the manhole comprises two vertical edges (33), parallel and chamfered, and two inclines edges (32) inclined by an angle of chamfering of the vertical edges, the inclined edges being provided with guide slotted holes (27) allowing slippage of the manhole on a frame edge (24").

* * * * *